US011326764B1

(12) United States Patent
Huang

(10) Patent No.: US 11,326,764 B1
(45) Date of Patent: May 10, 2022

(54) REFLECTED LIGHT PROJECTION DEVICE

(71) Applicant: ZHONGSHAN BOLANG ELECTRONIC TECHNOLOGY CO., LTD., Zhongshan (CN)

(72) Inventor: Chunchu Huang, Cili County, Hunan Province (CN)

(73) Assignee: ZHONGSHAN BOLANG ELECTRONIC TECHNOLOGY CO., LTD., Zhongshan (CN)

( * ) Notice: Subject to any disclaimer, the term of this patent is extended or adjusted under 35 U.S.C. 154(b) by 0 days.

(21) Appl. No.: 17/542,365

(22) Filed: Dec. 4, 2021

(30) Foreign Application Priority Data

Sep. 30, 2021 (CN) ..... 202122408926.2

(51) Int. Cl.
*F21V 14/04* (2006.01)
*F21V 7/04* (2006.01)

(52) U.S. Cl.
CPC ..... *F21V 14/04* (2013.01); *F21V 7/04* (2013.01)

(58) Field of Classification Search
CPC ..... F21V 14/04
See application file for complete search history.

(56) References Cited

U.S. PATENT DOCUMENTS 5,902,032 A * 5/1999 Hannigan ..... F21V 9/08 353/38
2009/0103293 A1* 4/2009 Harbers ..... F21K 9/65 362/231
2010/0033948 A1* 2/2010 Harbers ..... F21V 3/08 362/84
2015/0354782 A1* 12/2015 Konishi ..... F21V 7/10 362/277
2021/0381666 A1* 12/2021 Zheng ..... F21V 14/04

* cited by examiner

*Primary Examiner* — Julie A Bannan
(74) *Attorney, Agent, or Firm* — Li & Cai Intellectual Property (USA) Office

(57) ABSTRACT

A reflected light projection device is provided, comprising a projection light source assembly, a light source fixing plate for fixing the projection light source assembly, a rotatable reflector cup, a dust-proof light-transmitting sheet, and a motor driving the reflector cup to rotate. The dust-proof light-transmitting sheet, the reflector cup, the light source fixing plate, and the projection light source assembly are sequentially stacked and arranged on the motor, and the projection light source assembly, the light source fixing plate, and the reflector cup are respectively provided with a first opening, a second opening, and a third opening through which the motor passes, and a light emitted by the projection light source assembly directly irradiates the reflector cup that rotates under a drive of the motor, and the light is reflected by the reflector cup and then projected to a surface of an external medium through the dust-proof light-transmitting sheet.

18 Claims, 4 Drawing Sheets

REFLECTED LIGHT PROJECTION DEVICE

CROSS-REFERENCE TO RELATED APPLICATIONS

This application claims priority of China Patent Application No. 202122408926.2, filed on Sep. 30, 2021, the content of which is hereby incorporated by reference in its entirety.

FIELD OF THE DISCLOSURE

The present disclosure relates to a reflected light projection device.

BACKGROUND OF THE DISCLOSURE

In the past, various lighting fixtures to create atmosphere, such as starry sky projector lamps, were generally used in theaters, studios, bars, discos and other stage entertainment venues. However, with the rapid growth of the global economy, every family is living a happy life, which makes people's pursuit of various materials more and more abundant, and the atmosphere projection lamp gradually enters the family life.

Such lamps that enter family life must be portable, small, with music, low power consumption, environmentally friendly, low-cost and multi-functional. This kind of lamps can project monochromatic or multi-color water waves or various line-shaped patterns, which can create a warm and romantic scene. When multi-color combination is displayed, it can produce a flame-like scene, which enriches people's life, can make people relax from all kinds of complicated moods and enjoy this wonderful time.

Most of the existing various atmosphere projection lamps use the optical transmission principle to illuminate one or two relatively staggered rotating transparent interference wheel water-patterned plates with uneven surfaces through high-power LEDs (light-emitting diode) (light sources) and then transmit them to a focus. Or it can achieve the effect of water ripples or line fluctuations and ripples on the film printed with patterns.

SUMMARY OF THE DISCLOSURE

A reflected light projection device is provided according to a first aspect of the disclosure, comprising a projection light source assembly, a rotatable reflector cup, a dust-proof light-transmitting sheet, and a motor configured to drive the reflector cup to rotate, wherein the dust-proof light-transmitting sheet, the reflector cup, and the projection light source assembly are sequentially stacked and arranged on the motor, and a light emitted by the projection light source assembly directly irradiates the reflector cup that rotates under a drive of the motor, and the light is reflected by the reflector cup and then projected to a surface of an external medium through the dust-proof light-transmitting sheet.

Further, a projection device is provided according to a second aspect of the disclosure, comprising a projection light source assembly, a light source fixing plate configured to fix the projection light source assembly, a reflector cup, and a dust-proof light-transmitting sheet, the projection light source assembly, the light source fixing plate, the reflector cup and the dust-proof light-transmitting sheet being sequentially stacked, wherein a mirror reflective surface of an inner wall of the cup body is composed of a plurality of reflective planes, and the dust-proof light-permeable sheet is provided with a striped uneven surface; a light emitted by the projection light source assembly directly irradiates the reflector cup and then is projected to a surface of an external medium through the dust-proof light-transmitting sheet.

BRIEF DESCRIPTION OF THE DRAWINGS

The embodiments of the present disclosure will now be explained in further detail only by referring to the examples of the accompanying drawings.

Figure 1:
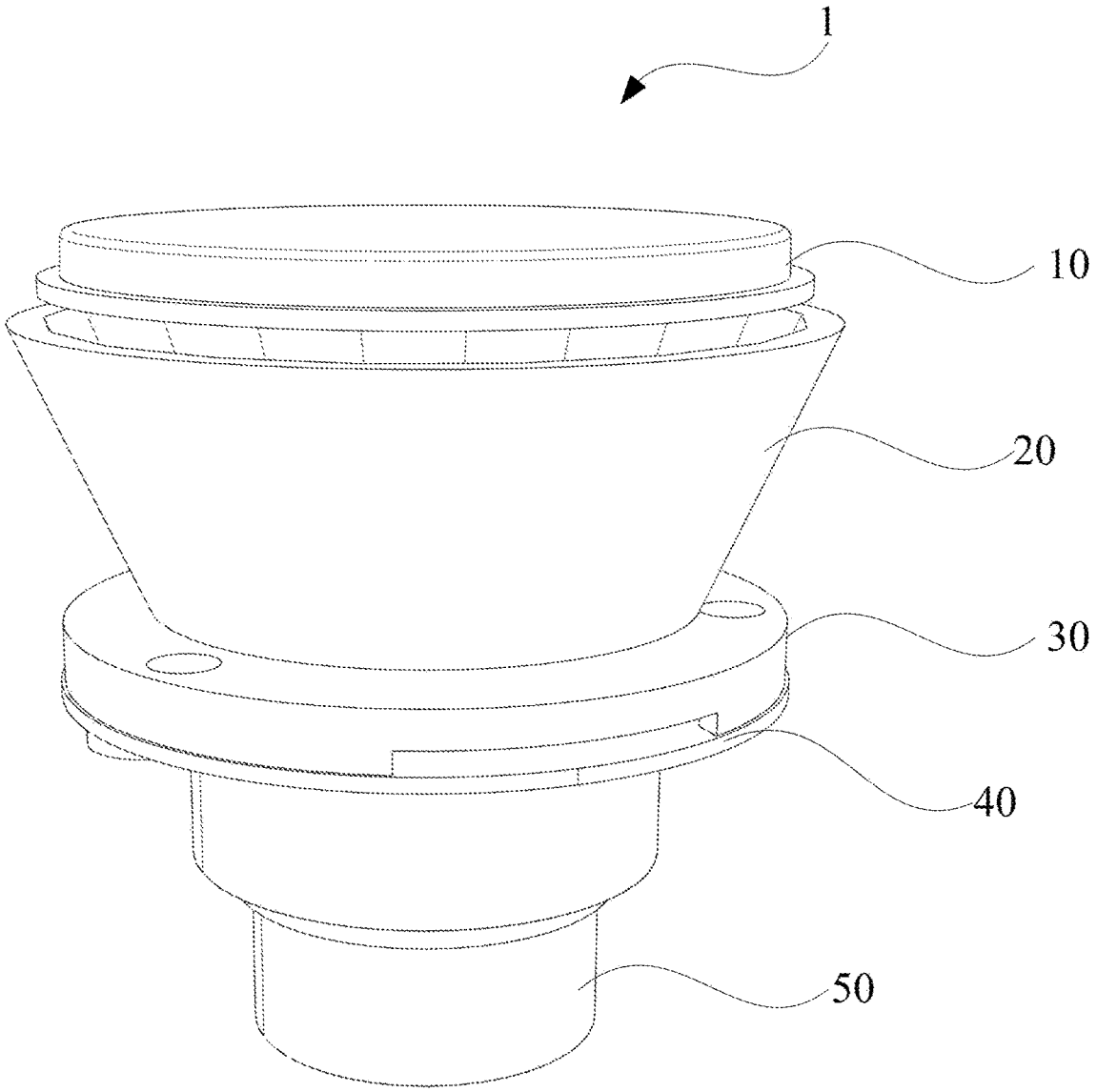
FIG. 1 is a schematic diagram showing the overall structure of the reflected light projection device related to the present disclosure.

Reference numeral: 1. reflected light projection device, 10. dust-proof and light-transmitting sheet, 110. striped uneven surface, 20. reflector cup, 21. cup body, 210. circular cone body, 220. mirror reflective surface, 230. large open end, 240. small open end, 251. first rib, 252. second rib, 253. third rib, 30. light source fixing plate, 310. second opening, 320. fourth opening, 330. fifth opening, 40. projection light source assembly, 41. supporting board, 410. first opening, 420. first light source, 430. second light source, 50. motor, 510. rotating shaft.

DETAILED DESCRIPTION OF THE EXEMPLARY EMBODIMENTS

In an embodiment, a reflected light projection device is provided, comprising: a projection light source assembly; a rotatable reflector cup; a dust-proof light-transmitting sheet; and a motor configured to drive the reflector cup to rotate, wherein the dust-proof light-transmitting sheet, the reflector cup, and the projection light source assembly are sequentially stacked and arranged on the motor, and wherein a light emitted by the projection light source assembly directly irradiates the reflector cup that rotates under a drive of the motor, and the light is reflected by the reflector cup and then projected to a surface of an external medium through the dust-proof light-transmitting sheet.

Optionally, the projection light source assembly is provided with a first opening through which a rotating shaft of the motor passes.

Optionally, the reflected light projection device further comprises a light source fixing plate configured to fix the projection light source assembly, wherein the dust-proof light-transmitting sheet, the reflector cup, the light source fixing plate and the projection light source assembly are sequentially stacked and arranged on the motor.

Optionally, the light source fixing plate is provided with a second opening through which a rotating shaft of the motor passes.

Optionally, the reflector cup comprises a funnel-shaped cup body and a convex circular cone body built into the cup body, wherein the cup body and the circular cone body are fixedly connected by one or more ribs.

Optionally, the circular cone body is centrally provided with a third opening; a rotating shaft of the motor is inserted into the third opening to drive the reflector cup to rotate.

Optionally, a mirror reflective surface of an inner wall of the cup body is composed of a plurality of reflective planes, and a light irradiated on the plurality of reflective planes is reflected to form a number of reflected lights with different reflection angles interleaved.

Optionally, a small open end of the cup body is fixedly connected with the circular cone body through three ribs equally spaced along a circumferential direction, and a large open end of the cup body is covered with the dust-proof light-transmitting sheet.

Optionally, the plurality of reflective planes are of identical shapes, and any of boundary lines between two adjacent reflective planes linearly extends from a small open end of the cup body to a large open end of the cup body.

Optionally, the dust-proof light-permeable sheet is provided with a striped uneven surface, such that a number of transmitted lights transmitted through the dust-proof light-permeable sheet are connected to form a pattern of water ripples or clouds and projected onto the surface of the external medium.

Optionally, the projection light source assembly comprises a supporting board and a light source arranged on the supporting board.

Optionally, the first opening is formed in the supporting board, and a plurality of the light sources are evenly arranged around the first opening.

Optionally, the reflected light projection device further comprises a light source fixing plate provided with a fourth opening corresponding to the light source, and the projection light source assembly is fixed to the light source fixing plate by making the light source pass through the fourth opening.

Optionally, the light source passes through the reflector cup and directly irradiate lights onto the reflector cup that rotates under a drive of the motor.

Optionally, the reflector cup comprises a funnel-shaped cup body and a column which is inside the cup body and is fixedly connected with the cup body via a rib, and wherein the rib is recessed upwardly so as to void contact with the light source while the reflector cup is rotating.

Optionally, the light source passes through a small open end of the cup body and directly irradiate lights onto the reflector cup that rotates under a drive of the motor.

Optionally, center points of the dust-proof light-transmitting sheet, the reflector cup, the light source fixing plate, and the projection light source assembly are on a same central axis as a rotating shaft of the motor.

Optionally, a rotating shaft of the motor drives the reflector cup to rotate at 360 degrees forward and backward in both directions.

In another embodiment, a projection device is provided, comprising a projection light source assembly, a light source fixing plate configured to fix the projection light source assembly, a reflector cup, and a dust-proof light-transmitting sheet, the projection light source assembly, the light source fixing plate, the reflector cup and the dust-proof light-transmitting sheet being sequentially stacked, wherein a mirror reflective surface of an inner wall of the cup body is composed of a plurality of reflective planes, and the dust-proof light-permeable sheet is provided with a striped uneven surface; a light emitted by the projection light source assembly directly irradiates the reflector cup and then is projected to a surface of an external medium through the dust-proof light-transmitting sheet.

Optionally, the reflector cup comprises a funnel-shaped cup body and a column which is inside the cup body and is fixedly connected with the cup body via a rib; the projection device further comprises a motor, a rotating shaft of the motor being fixedly connected with the column to drive the reflector cup to rotate.

Hereinafter, the preferred embodiments of the present disclosure will be described in detail with reference to the drawings. In the following description, the same symbols are assigned to the same components, and repeated descriptions are omitted. In addition, the drawings are only schematic diagrams, and the ratio of the dimensions between the components or the shapes of the components may be different from the actual ones.

FIG. 1 is a schematic diagram showing the overall structure of the reflected light projection device related to the present disclosure.

Reference is made to FIG. 1. The appearance of the reflected light projection device 1 of the present disclosure may be roughly the gyro-shaped structure shown in FIG. 1, and may include a dust-proof and light-permeable sheet 10, a reflector cup 20, a light source fixing plate 30, a projection light source assembly 40, and a motor 50.

In some examples, the reflected light projection device 1 can also be designed into other shape structures by adjusting the shapes or shapes of the dust-proof light-transmitting sheet 10, the reflector cup 20, the light source fixing plate 30, and the projection light source assembly 40 according to the user's aesthetic requirements.

In this embodiment, the dust-proof light-transmitting sheet 10, the reflector cup 20, the light source fixing plate 30, and the projection light source assembly 40 may be stacked on the motor 50 in order from top to bottom. In some examples, the connection or fixing method among the dust-proof light-transmitting sheet 10, the reflector cup 20, the light source fixing plate 30, and the projection light source assembly 40 may be bolts, pins, slide fasteners or clips commonly used in the prior art. The methods of buckle fixing, welding, adhesive fixing, or shaft connection are not specifically limited in this embodiment.

Specifically, in this embodiment, the reflected light projection device 1 may include a projection light source assembly 40, a light source fixing plate 30 configured for fixing the projection light source assembly 40, a rotatably movable reflector cup 20, a dust-proof and light-transmitting sheet 10, and a motor 50 that drives the reflector cup 20 to rotate. The dust-proof light-transmitting sheet 10, the reflector cup 20, the light source fixing plate 30, and the projection light source assembly 40 may be stacked on the motor 50 in order from top to bottom. The projection light source assembly 40, the light source fixing plate 30, and the reflector cup 20 can be respectively provided with a first opening 410, a second opening 310, and a third opening 211 through which the motor 50 passes. Specifically, the projection light source assembly 40 can be provided with a first opening 410, the light source fixing plate 30 can be provided with a second opening 310, and the reflector cup 20 can be provided with a third opening 211 (refer to FIG. 4 for details). The light emitted by the projection light source assembly 40 can be directly irradiated to the reflector cup 20 that is rotated and driven by the motor 50, and the light is reflected by the reflector cup 20 and can be projected to the surface of the external medium through the dust-proof light-transmitting sheet 10. The surface of the external medium can be, for example, a wall, a ceiling, a floor, and the like.

In the present disclosure, by stacking the dustproof light-transmitting sheet 10, the reflector cup 20, the light source fixing plate 30, and the projection light source assembly 40 on the motor 50 in sequence, the light emitted by the projection light source assembly 40 can be directly irradiated to the reflector cup 20, and by making the motor 50 pass through the first opening 410 of the projection light source assembly 40, the second opening 310 of the light source fixing plate 30, and the third opening 211 of the reflector 20 in turn, the motor 50 can drive reflector cup 20 to rotate. In this case, the light emitted by the projection light source assembly 40 can be directly irradiated to the rotating reflector 20, so that the light is reflected by the reflector cup 20 and then projected to the surface of the external medium through the dust-proof light-transmitting sheet 10 to form a specific pattern. As a result, the reflected light projection device 1 has a simple structure and can also improve the utilization rate of the light source.

Figure 2:
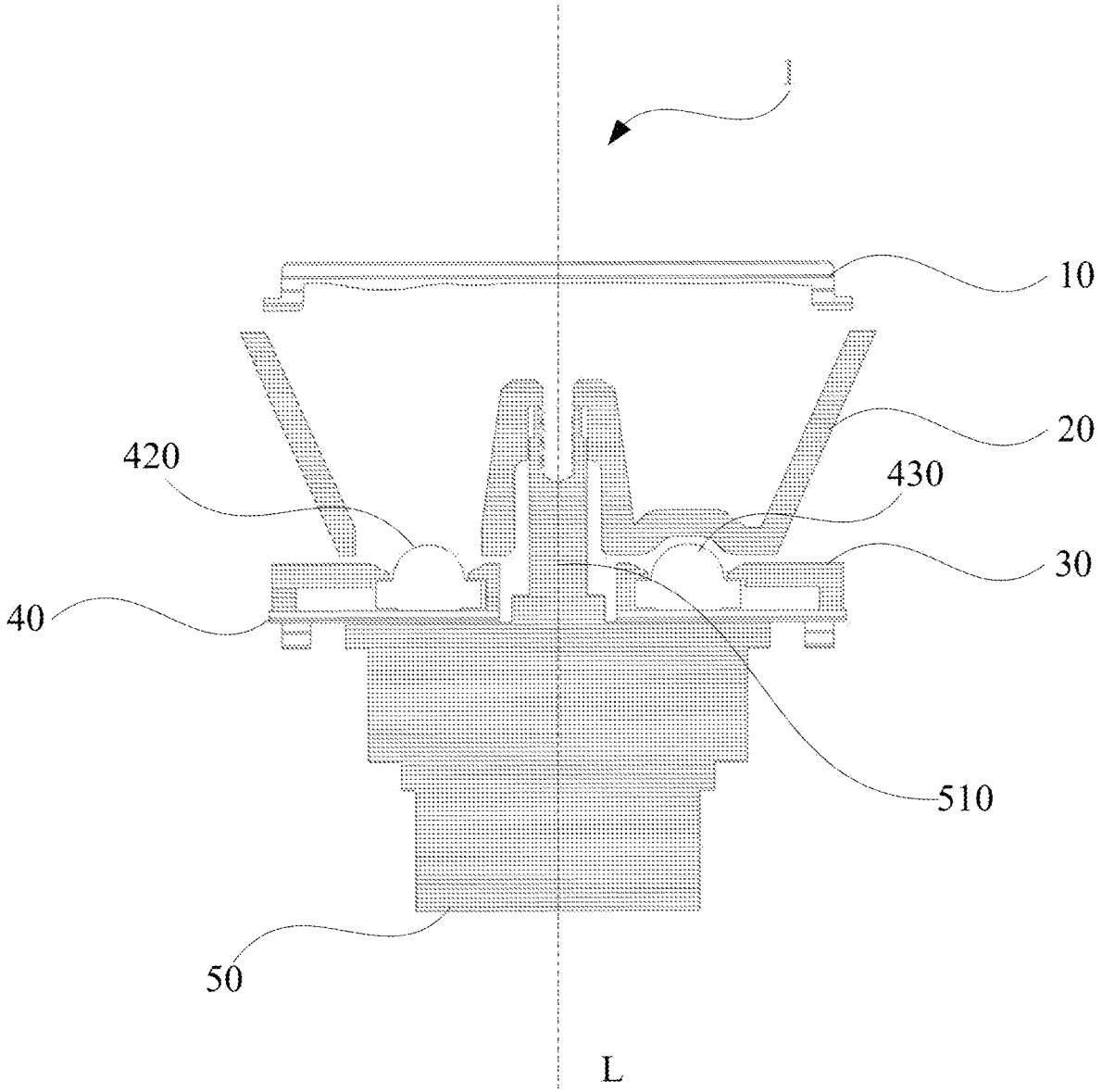
FIG. 2 is a schematic diagram showing the cross-sectional structure of the reflected light projection device related to the present disclosure.
Figure 3:
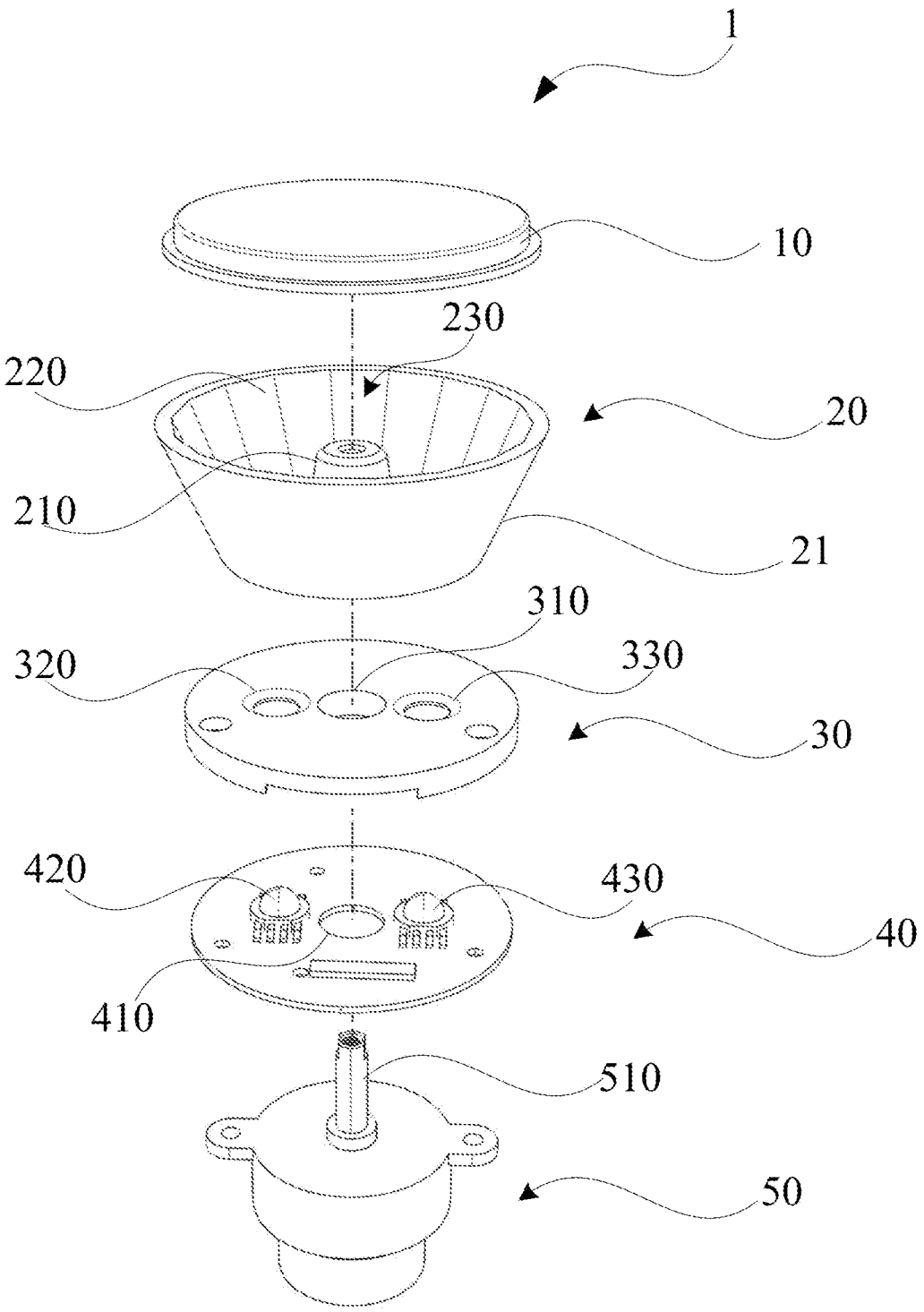
FIG. 3 is an exploded view showing a viewing angle of the reflected light projection device related to the present disclosure.
Figure 4:
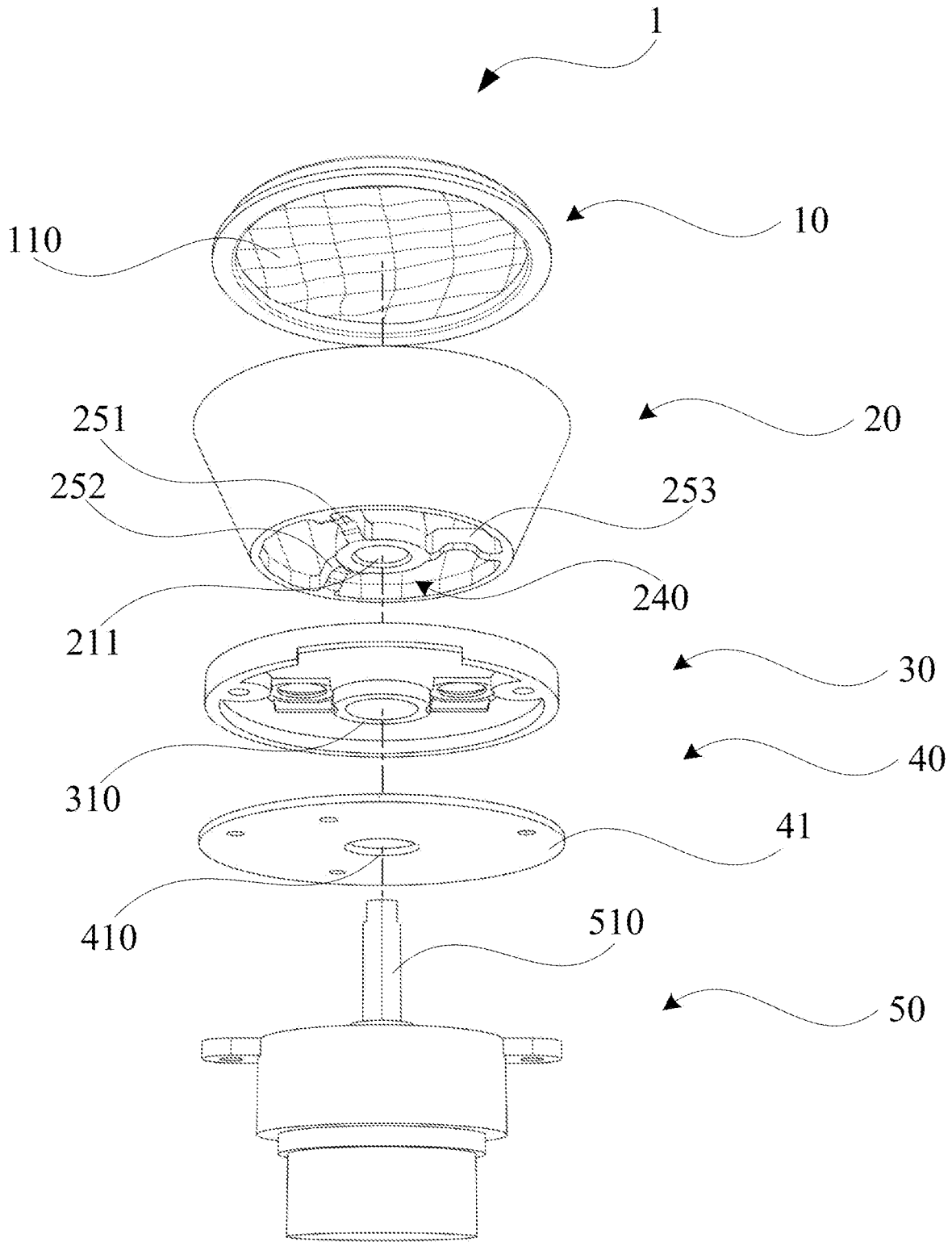
FIG. 4 is n exploded view showing another viewing angle of the reflected light projection device related to the present disclosure.

FIG. 2 is a schematic diagram showing the cross-sectional structure of the reflected light projection device related to the present disclosure. FIG. 3 is an exploded view showing a viewing angle of the reflected light projection device related to the present disclosure. FIG. 4 is an exploded view showing another viewing angle of the reflected light projection device related to the present disclosure.

Hereinafter, the specific structure and working principle of each component (which may include the dust-proof light-transmitting sheet 10, the reflector cup 20, the light source fixing plate 30, the projection light source assembly 40 and the motor 50) of the solution will be described in detail with reference to FIGS. 2 to 4.

In this embodiment, the reflector cup 20 may include a funnel-shaped cup body 21 and a convex-shaped circular cone body 210 built in the cup body 21. The cup body 21 and the circular cone body 210 may be fixedly connected by three ribs (which may include a first rib 251, a second rib 252, and a third rib 253). The rotating shaft 510 of the motor 50 can be inserted into the circular cone body 210 to drive the reflector cup 20 to rotate. In an example, the first rib 251, the second rib 252, and the third rib 253 are equally spaced along a circumferential direction.

The mirror reflective surface 220 of the inner wall of the cup body 21 may be composed of plurality of reflective planes. The light irradiated on the plurality of reflective planes can form a number of reflected lights with different reflection angles interlaced after being reflected. In this case, it is convenient to make several reflected lights with different reflection angles interleaved after being reflected. In an embodiment, the plurality of reflective planes are of identical shapes, and any of boundary lines between two adjacent reflective planes linearly extends from a small open end of the cup body 21 to a large open end of the cup body 21.

In some examples, referring to FIG. 3, the reflective plane may be designed according to the funnel-shaped cup body 21 to be evenly arranged on the inner wall of the cup body 21 in a trapezoidal shape with a wide top and a narrow bottom. In this case, since the angles at which the reflective planes are arranged are different, the reflection angles of the reflected light generated by the reflection of the light irradiated on the reflective planes are also different. Meanwhile, as the cup body 21 is in funnel-shaped design, with a wide end in the upper part and a narrow end in the lower part, such a design can make the lights emitted from the bottom of the cup body 21 interleaved together after being reflected.

In this embodiment, the small open end 240 of the reflector cup 20 can be fixedly connected to the circular cone body 210 through three ribs (which may include a first rib 251, a second rib 252, and a third rib 253), and the large open end 230 of the reflector cup 20 can be covered with a dust-proof and light-transmitting sheet 10. In this case, the circular cone body 210 can be conveniently fixed by three ribs. On the other hand, the reflector cup 20 can be conveniently connected to the motor 50 through the circular cone body 210.

In some examples, the number of ribs may not be fixed. The number of ribs may be one, and the rib may traverse the circular cone body 210 for fixing the connection between the traverse circular cone body 210 and the cup body 21. In other examples, the number of ribs may be 2, 4, 5, 6, 7, 8, 9, 10, etc. As a result, it is convenient to select an appropriate number of ribs for fixing the connection between the circular cone body 210 and the cup body 21.

In some examples, the circular cone body 210 may be provided with a third opening 211 (that is, the third opening 211 opened in the reflector cup 20) at one end of the circular cone body 210 at the small opening end 240, and the rotating shaft 510 of the motor 50 may be inserted into the third opening 211. The third opening 211 drives the reflector cup 20 to rotate. As a result, it is convenient to insert the rotating shaft 510 of the motor 50 into the third opening 211 to drive the reflector cup 20 to rotate.

In the embodiment, the reflected light is projected onto the dust-proof light-transmitting sheet 10 with the strip-shaped uneven surface 110, and the angle changes irregularly, and several pieces of transmitted light that are transmitted through the dust-proof light-transmitting sheet 10 are connected to form a pattern of water ripples or clouds to be projected onto the surface of the external medium. As a result, the transmitted light can be connected to form a pattern of water ripples or clouds and projected onto the surface of the external medium.

In some examples, the strip-shaped uneven surface 110 of the dust-proof light-transmitting sheet 10 may be a strip-shaped uneven surface 110 shaped like a grid, and the strips formed by each grid may not be on a same horizontal plane. As a result, the light rays can undergo irregular angle changes and transformations after being projected through the strip planes formed by the various grids.

In this case, the light emitted from the bottom of the cup body 21 is reflected by the reflective planes of the cup body 21 and then interleaved. These interleaved reflected lights are then directed to the dust-proof light-transmitting sheet 10, and the transmitted light formed after being transmitted through the dust-proof light-transmitting sheet 10 can be connected to form a pattern similar to water ripples or clouds and projected onto the surface of the external medium.

In this embodiment, the projection light source assembly 40 may include a supporting board 41 and a first light source 420 and a second light source 430 arranged on both sides of the supporting board 41. The first light source 420 and the second light source 430 may be symmetrically arranged on both sides of the first opening 410. Therefore, the first light source 420 and the second light source 430 can be conveniently used to emit light. On the other hand, the symmetrical arrangement of the two light sources (the first light source 420 and the second light source 430) can make the light emitted by the each reflective plane of the cup body 21.

In some examples, the number of light sources may not be fixed, for example, the number of light sources may also be 1, 3, 4, 5, etc. As a result, a suitable number of light sources can be set according to requirements.

In some examples, the first light source 420 and the second light source 430 may be monochromatic or multi-color light sources, and the first light source 420 and the second light source 430 may be LED lights. In this case, the multi-color light source can facilitate the reflected light projection device 1 to form a more gorgeous pattern.

In some examples, as shown in FIGS. 2 and 4, the small open end 240 of the reflector cup 20 is fixedly connected to the circular cone body 210 via ribs, such as the first rib 251, the second rib 252, and the third rib 253. such ribs may be recessed upwardly into an arc shape to avoid contact with the first light source 420 and the second light source 430. In other words, when the reflector cup 20 rotates clockwise or counterclockwise, the arc-shaped recess in the rib(s) can avoid contact with the light sources 420 and 430, so that the ribs will not collide with the light source.

In this embodiment, the reflected light projection device 1 may further include a driving main control board, and the driving main control board may be used to drive the first light source 420 and the second light source 430 to emit light. As a result, the first light source 420 and the second light source 430 can be easily driven to emit light.

In this case, the motor 50 drives the reflector 20 to rotate, and makes the illumination light (monochromatic or multi-color light) irradiated on the reflector dynamically move, so that the light irradiated on the inner wall of the reflector forms a reflected light and is reflected out from the plurality of reflective planes, forming countless light rays of different angles interleaved and moved together, and finally after being transmitted through the dust-proof and light-permeable sheet 10, a pattern similar to forming water ripples or clouds is formed and projected onto the surface of the external medium.

In this embodiment, the light source fixing plate 30 may be provided with a fourth opening 320 and a fifth opening 330 corresponding to the first light source 420 and the second light source 430, and the size of the openings of the fourth opening 320 and the fifth opening 330 can be set to match the size of the first light source 420 and the second light source 430. The projection light source assembly 40 is fixed on the lower end of the light source fixing plate 30 by making the first light source 420 and the second light source 430 pass through the fourth opening 320 and the fifth opening 330 respectively. In some examples, the light source fixing plate 30 may be designed as a groove-shaped structure that can just accommodate the projection light source assembly 40. As a result, the projection light source assembly 40 can be easily fixed in the light source fixing plate 30.

In this embodiment, the first light source 420 and the second light source 430 can pass through the small opening end 240 of the reflector cup 20 and directly irradiate lights onto the reflector cup 20 that is driven by the motor 50 to rotate and move.

In some examples, the shape of the supporting board 41 and the light source fixing plate 30 may be a sheet-like circular plate structure, and the size of the supporting board 41 and the light source fixing plate 30 may be approximately the same. As a result, assembly space can be saved.

It can be understood that, due to the generally hollow structure at the small open end 240 of the reflector cup 20 except for the three ribs, in this case, the first light source 420 and the second light source 430 passing through the light source fixing plate 30 can directly pass through or can be in the small opening end 240 of the reflector cup 20, and the light emitted by the first light source 420 and the second light source 430 can be directly irradiated to the inner wall of the reflector cup 20.

In this embodiment, referring again to FIGS. 2 to 4, the center points of the projection light source assembly 40, the light source fixing plate 30, and the reflector 20 may be respectively provided with a first opening 410, a second opening 310 and a third opening 211 through which the shaft 510 passes. The center point of the dust-proof light-transmitting sheet 10, the reflector cup 20, the light source fixing plate 30, the projection light source assembly 40 and the rotating shaft 510 of the motor 50 may be on a same central axis L. In this case, on the one hand, this symmetrical design can facilitate the assembly of the reflected light projection device 1 (the assembly method will be described later); on the other hand, it can be beneficial to uniformly irradiate the light emitted by the first light source 420 and the second light source 430 to the reflective plane of the cup body 21.

In this embodiment, the rotating shaft 510 of the motor 50 can drive the reflector cup 20 to rotate at 360 degrees in both directions (that is, clockwise and/or counterclockwise). Of course, in some other examples, the rotation can also be performed at any angle within 360 degrees. In this way, it is possible to conveniently change the irradiation angle of the light emitted by the first light source 420 and the second light source 430.

In some examples, when assembling the reflected light projection device 1, the projection light source assembly 40 may be fixed in the light source fixing plate 30, and then the rotating shaft 510 of the motor 50 is inserted into the first opening 410 and the second opening 310, Furthermore, the rotating shaft 510 is inserted into the third opening 211 of the reflector cup 20 (that is, the third opening 211 of the circular cone body 210), and finally the dust-proof and light-transmitting sheet 10 is installed on the reflector cup 20. Of course, the above assembly method is not fixed, and the projection light source assembly 40, the light source fixing plate 30, and the reflector 20 can be aligned and placed on the rotating shaft 510 of the motor 50 through the first opening 410, the second opening 310, and the third opening 211 in sequence, and finally the dust-proof light-transmitting sheet 10 should be arranged on the reflector cup 20. The assembly method is simple and easy to operate.

In the present disclosure, by stacking the dust-proof light-transmitting sheet 10, the reflector cup 20, the light source fixing plate 30, and the projection light source assembly 40 in order, the light emitted by the projection light source assembly 40 can be directly irradiated to the reflector cup 20. And by sequentially making the motor 50 pass through the first opening 410 of the projection light source assembly 40, the second opening 310 of the light source fixing plate 30, and the third opening 211 of the reflector cup 20, the motor 50 can drive the reflector cup 20 to rotate. In this case, the light emitted by the projection light source assembly 40 can be directly irradiated to the rotating reflector cup 20, so that the light is reflected by the reflector cup 20 and then projected to the surface of the external medium through the dust-proof light-transmitting sheet 10 to form a specific pattern. Therefore, the reflected light projection device 1 has a simple structure and can also improve the utilization rate of the light source.

Therefore, the reflected light projection device 1 involved in the present disclosure has a simple structure and a simple assembly method, and the utilization rate of the light source is also greatly improved.

Although the present disclosure has been specifically described above in conjunction with the accompanying drawings and embodiments, it can be understood that the foregoing description does not limit the present disclosure in any form. Those skilled in the art can make deformations and changes to the present disclosure as needed without departing from the essential spirit and scope of the present disclosure, and these deformations and changes fall within the scope of the present disclosure.

What is claimed is:

1. A reflected light projection device, comprising:

a projection light source assembly;

a rotatable reflector cup;

a dust-proof light-transmitting sheet; and a motor configured to drive the reflector cup to rotate, wherein the dust-proof light-transmitting sheet, the reflector cup, and the projection light source assembly are sequentially stacked and arranged on the motor, wherein a light emitted by the projection light source assembly directly irradiates the reflector cup that rotates under a drive of the motor, and the light is reflected by the reflector cup and then projected to a surface of an external medium through the dust-proof light-transmitting sheet, and wherein the projection light source assembly is provided with a first opening through which a rotating shaft of the motor passes.

2. The reflected light projection device according to claim 1, further comprising a light source fixing plate configured to fix the projection light source assembly, wherein the dust-proof light-transmitting sheet, the reflector cup, the light source fixing plate and the projection light source assembly are sequentially stacked and arranged on the motor.

3. The reflected light projection device according to claim 2, wherein the light source fixing plate is provided with a second opening through which a rotating shaft of the motor passes.

4. The reflected light projection device according to claim 1, wherein the reflector cup comprises a funnel-shaped cup body and a convex circular cone body built into the cup body, wherein the cup body and the circular cone body are fixedly connected by one or more ribs.

5. The reflected light projection device according to claim 4, wherein the circular cone body is centrally provided with a third opening; a rotating shaft of the motor is inserted into the third opening to drive the reflector cup to rotate.

6. The reflected light projection device according to claim 4, a mirror reflective surface of an inner wall of the cup body is composed of a plurality of reflective planes, and a light irradiated on the plurality of reflective planes is reflected to form a number of reflected lights with different reflection angles interleaved.

7. The reflected light projection device according to claim 4, wherein a small open end of the cup body is fixedly connected with the circular cone body through three ribs equally spaced along a circumferential direction, and a large open end of the cup body is covered with the dust-proof light-transmitting sheet.

8. The reflected light projection device according to claim 6, wherein the plurality of reflective planes are of identical shapes, and any of boundary lines between two adjacent reflective planes linearly extends from a small open end of the cup body to a large open end of the cup body.

9. The reflected light projection device according to claim 1, wherein the dust-proof light-permeable sheet is provided with a striped uneven surface, such that a number of transmitted lights transmitted through the dust-proof light-permeable sheet are connected to form a pattern of water ripples or clouds and projected onto the surface of the external medium.

10. The reflected light projection device according to claim 1, wherein the projection light source assembly comprises a supporting board and a light source arranged on the supporting board.

11. The reflected light projection device according to claim 10, wherein the first opening is formed in the supporting board, and a plurality of the light sources are evenly arranged around the first opening.

12. The reflected light projection device according to claim 10, further comprising a light source fixing plate which is provided with a fourth opening corresponding to the light source, and the projection light source assembly is fixed to the light source fixing plate by making the light source pass through the fourth opening.

13. The reflected light projection device according to claim 10, wherein the light source passes through the reflector cup and directly irradiate lights onto the reflector cup that rotates under a drive of the motor.

14. The reflected light projection device according to claim 13, wherein the reflector cup comprises a funnel-shaped cup body and a column which is inside the cup body and is fixedly connected with the cup body via a rib, and wherein the rib is recessed upwardly so as to void contact with the light source while the reflector cup is rotating.

15. The reflected light projection device according to claim 14, wherein the light source passes through a small open end of the cup body and directly irradiate lights onto the reflector cup that rotates under a drive of the motor.

16. The reflected light projection device according to claim 2, wherein center points of the dust-proof light-transmitting sheet, the reflector cup, the light source fixing plate, and the projection light source assembly are on a same central axis as a rotating shaft of the motor.

17. The reflected light projection device according to claim 1, wherein a rotating shaft of the motor drives the reflector cup to rotate at 360 degrees forward and backward in both directions.

18. A projection device, comprising a projection light source assembly, a light source fixing plate configured to fix the projection light source assembly, a reflector cup, and a dust-proof light-transmitting sheet, the projection light source assembly, the light source fixing plate, the reflector cup and the dust-proof light-transmitting sheet being sequentially stacked, wherein a mirror reflective surface of an inner wall of the cup body is composed of a plurality of reflective planes, and the dust-proof light-permeable sheet is provided with a striped uneven surface; a light emitted by the projection light source assembly directly irradiates the reflector cup and then is projected to a surface of an external medium through the dust-proof light-transmitting sheet, and wherein the reflector cup comprises a funnel-shaped cup body and a column which is inside the cup body and is fixedly connected with the cup body via a rib; the projection device further comprises a motor, a rotating shaft of the motor being fixedly connected with the column to drive the reflector cup to rotate.

* * * * *